US010663251B2

(12) United States Patent
Lemarquand

(10) Patent No.: US 10,663,251 B2
(45) Date of Patent: May 26, 2020

(54) DEVICE FOR PROJECTING A PROJECTILE BY COMPRESSED AIR USING ELECTROMAGNETIC PISTON COMPRESSION, ASSOCIATED CONTROL METHOD

(71) Applicant: MAGNETO RESEARCH, Pessac (FR)

(72) Inventor: Guy Lemarquand, Beduer (FR)

(73) Assignee: TOKYO MARUI Co., Ltd., Tokyo (JP)

( * ) Notice: Subject to any disclaimer, the term of this patent is extended or adjusted under 35 U.S.C. 154(b) by 0 days.

(21) Appl. No.: 15/776,781

(22) PCT Filed: Nov. 17, 2016

(86) PCT No.: PCT/EP2016/078034

§ 371 (c)(1),
(2) Date: Aug. 24, 2018

(87) PCT Pub. No.: WO2017/085202

PCT Pub. Date: May 26, 2017

(65) Prior Publication Data

US 2019/0249945 A1 Aug. 15, 2019

(30) Foreign Application Priority Data

Nov. 17, 2015 (FR) ..... 15 61055

(51) Int. Cl.
*F41B 11/64* (2013.01)
*F41B 6/00* (2006.01)

(52) U.S. Cl.
CPC ..... *F41B 11/64* (2013.01); *F41B 6/003* (2013.01)

(58) Field of Classification Search
CPC ..... F41B 11/64; F41B 6/00; F41B 6/003
USPC ..... 124/71, 65
See application file for complete search history.

(56) References Cited

U.S. PATENT DOCUMENTS 2,568,432 A * 9/1951 Cook ..... F41B 11/71 124/65
5,223,662 A 6/1993 Igenbergs et al.
6,901,689 B1 * 6/2005 Bergstrom ..... F41A 3/94 42/1.06
7,607,424 B2 * 10/2009 Monks ..... F41B 11/57 124/77

(Continued)

FOREIGN PATENT DOCUMENTS

CN 204313712 5/2015
JP 2015-064133 4/2015

OTHER PUBLICATIONS

"International Search Report (Form PCT/ISA/210) of PCT/EP2016/078034", with English translation thereof, dated Feb. 6, 2017, pp. 1-6.

*Primary Examiner* — John Cooper
(74) *Attorney, Agent, or Firm* — JCIPRNET

(57) ABSTRACT

The invention relates to a device for projecting a projectile B using a compressed air, in particular provided to be built into a replica weapon, associated with a source of electrical energy. The device comprises a sheath (10) which receives an electromagnetic means (12) for moving a movable piston (34) within the sheath (10) between a thrust nose (14) sealing a front (10-1) of the sheath provided with a projection tube, and a breech (18) sealing a rear (10-2) of the sheath. The invention also relates to a method for controlling the device.

11 Claims, 9 Drawing Sheets

(56) References Cited

U.S. PATENT DOCUMENTS

| | | | | |
|---|---|---|---|---|
| 9,404,707 | B2 * | 8/2016 | Gore | F41B 11/647 |
| 2010/0071680 | A1 * | 3/2010 | Tseng | F41A 19/33 124/80 |
| 2016/0363414 | A1 * | 12/2016 | Tseng | F41B 11/723 |

* cited by examiner

DEVICE FOR PROJECTING A PROJECTILE BY COMPRESSED AIR USING ELECTROMAGNETIC PISTON COMPRESSION, ASSOCIATED CONTROL METHOD

CROSS-REFERENCE TO RELATED APPLICATION

This application is a 371 application of the international PCT application serial no. PCT/EP2016/078034, filed on Nov. 17, 2016, which claims the priority benefit of France application no. 1561055, filed on Nov. 17, 2015. The entirety of each of the above-mentioned patent applications is hereby incorporated by reference herein and made a part of this specification.

TECHNICAL FIELD

The present invention relates to a device for projecting a projectile using compressed air which is compressed by an electromagnetic piston.

The invention also covers a method for controlling the device for projecting using compression by electromagnetic piston.

BACKGROUND ART

The recreational sport referred to as "Airsoft" is known, which consists of using replica weapons and projectiles for team games.

The power of the projectiles is limited in order to remain within the field of recreational and competitive sports games.

Many arrangements have been proposed over the years.

There are existing arrangements which use reserves of compressed gas to propel the projectile by means of a volume of pressurized gas released from the gas reserve on demand. These reserves may be of different sizes, but one of the problems is bulk. Either the volume is sufficient but the pressurized container is bulky, or cartridges of small volume are used but the possible number of shots is limited.

It is also necessary to fill the pressurized container or to buy cartridges, which is not very satisfactory.

Another arrangement which is very common and widely available commercially is based on electromechanical means. These electromechanical means comprise an electric motor and a set of gears driven by said motor, referred to as a "gear box". These gears have two functions: one is to feed a projectile to a thrust nose, and the other is to propel said projectile from the thrust nose using pressurized air.

The thrust nose is a hollow tube, sealingly connected to a fixed pressure chamber. This assembly is intended to be housed in a replica weapon.

The thrust nose can be in two positions, a rearward position allowing insertion of a pellet in front of said thrust nose, and a forward position where the thrust nose introduces the projectile into the barrel of the replica weapon.

This projectile, usually a pellet, comes from a reserve into its position in front of the thrust nose.

The fixed pressure chamber comprises a piston, movable in translation within said fixed pressure chamber. The front part of the movable piston carries means to form a seal with the fixed chamber within which it is movable in translation. The rear of the piston bears against one end of a spring interposed between the rear of said piston, the other end of the spring bearing against the bottom of a housing containing all the electromagnetic means.

The gears and the motor move the piston within the fixed pressure chamber towards the rear of the chamber, generally by means of a rack, which compresses the spring, and when the piston is moved back translationally as far as possible, the spring is simultaneously also compressed as much as possible.

The gear driving the piston is provided with a toothless pad, so that when it is rotated, immediately after maximum compression, said gear releases the piston which is then propelled forwards into the chamber by the relaxation of the spring. This displacement compresses the air in said chamber. This greatly accelerates the air in the thrust nose and this air then propels the projectile, in this case the pellet in the barrel. This mechanism is highly attractive because it uses electrical energy that can be stored in cells or batteries for powering the motor.

This type of energy is very practical, easily available, and easily rechargeable, with good autonomy. However, the thrust is directly dependent on the spring and it is known that a spring has properties which vary over time and which vary with the temperature. A spring has a major disadvantage: it releases a thrust that is irregular, with high power at the beginning of the thrust and fading at the end of its travel.

Finally, the electromechanical means consume large amounts of energy, particularly due to friction.

Instead it would be helpful to have either a constant released force or a progressively released force in order to launch the pellet by overcoming the inertia and accelerating said pellet once it is in motion, in other words controlling the acceleration of the pellet in order to optimize the transfer of energy.

Similarly, the release of the spring/piston as well the stopping of the spring/piston at the end of travel leads to an evident lack of flexibility, affecting the accuracy of the shot to say nothing of the discomfort for the shooter.

SUMMARY

This field is therefore in need of a mechanism that retains the advantages of electrical energy, which reduces consumption as much as possible in order to increase shot capacity or at equivalent capacity to reduce the weight of the replica weapon, and which generates little or no vibrations, impacts, and noise.

It would in fact be useful to reduce the noise of the mechanism, as the electromechanical means must necessarily make some noise due to the meshing of the gears, especially within a closed volume which acts as a sound amplifier, decreasing the stealth of the shooter.

The field is in particular need of technical performance which delivers optimum power for the same energy consumption, and therefore improves efficiency in launching the projectile.

The present invention thus can overcome the problems of the prior art, provide new features, and even offer control of the projection device.

DESCRIPTION OF THE DRAWINGS

The device and its control method are now described in detail for a particular non-limiting embodiment, this description being given with reference to the accompanying drawings. In these drawings, the different figures represent.

DESCRIPTION OF EMBODIMENT

Figure 1:
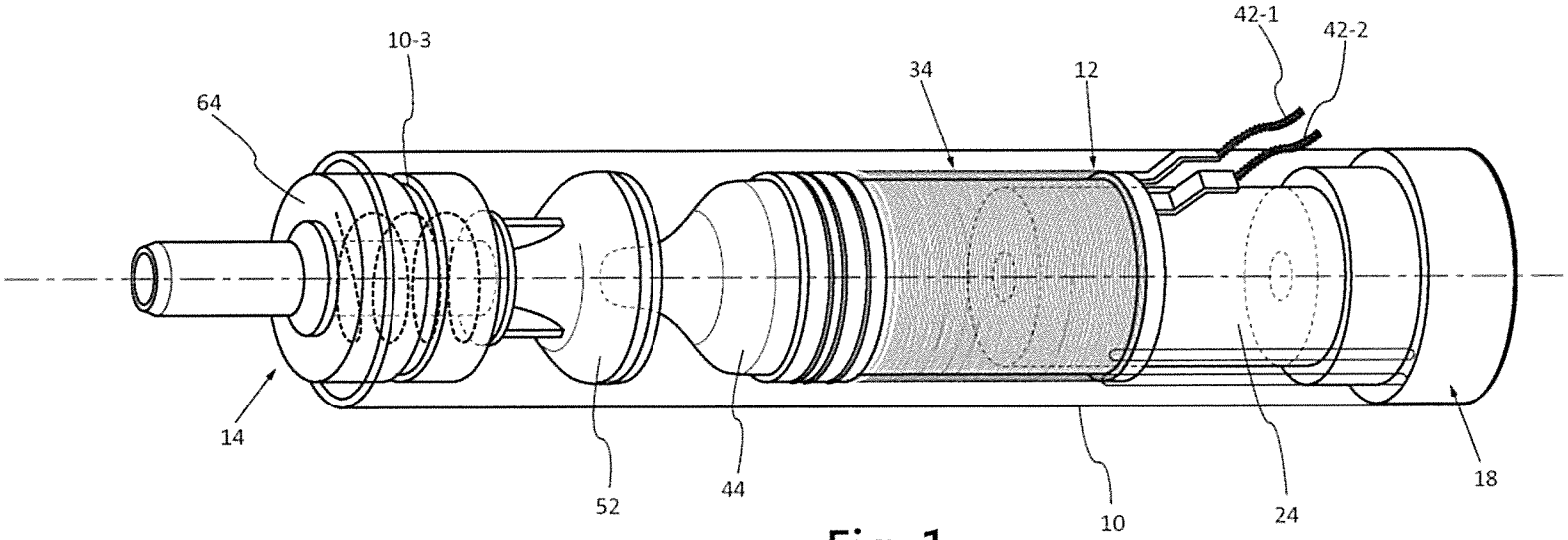
FIG. 1: a perspective view of the projection device according to the invention.
Figure 2:
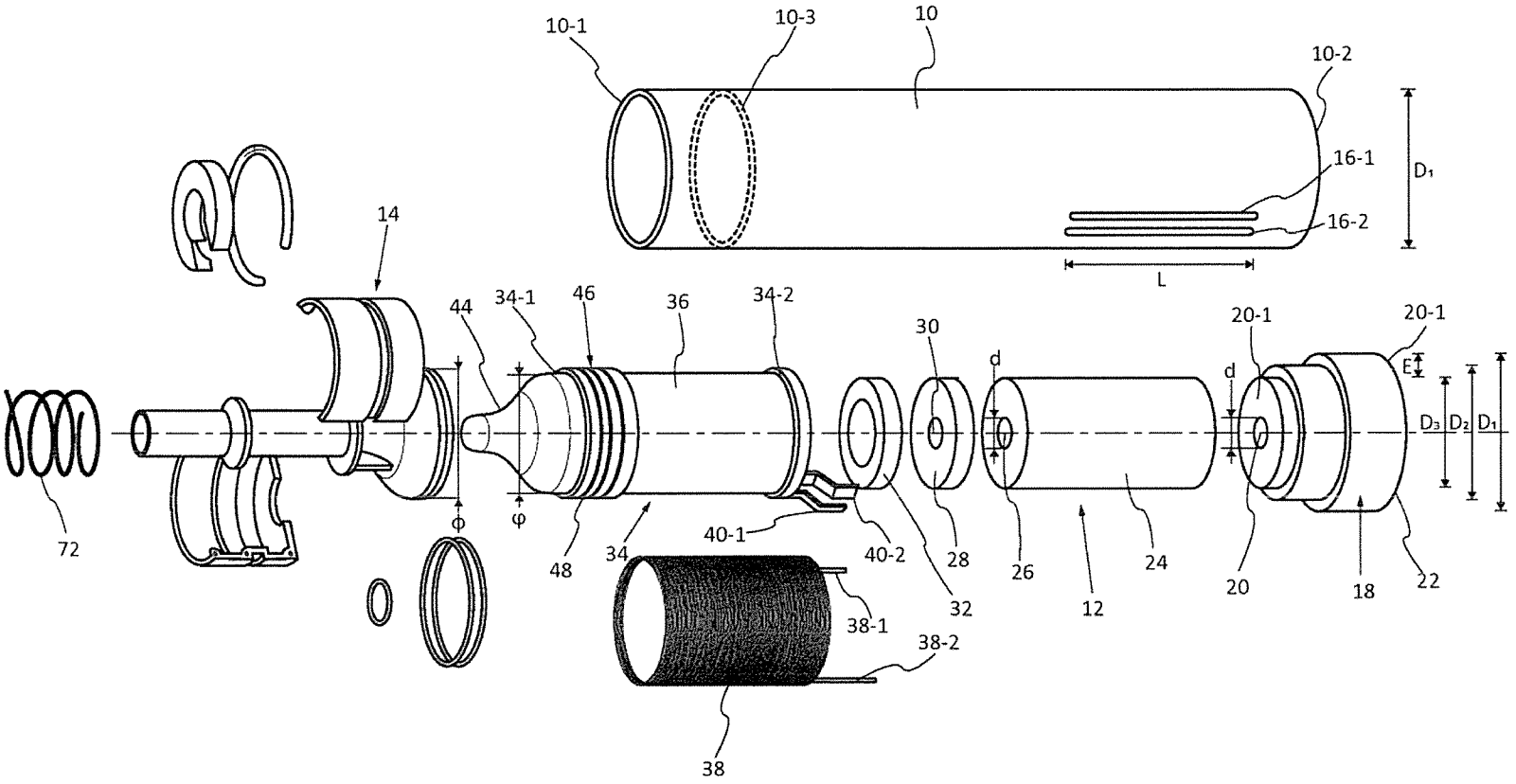
FIG. 2: an exploded view of the various components of said device represented in FIG. 1, FIG. 3: an exploded detailed section view of the movable piston, the core, and the field concentrator.

The invention is now described with reference to FIGS. 1 and 2, in order to define the component parts of the electromagnetic projection device according to the invention.

These various components are designed to be integrated into a housing that can be a replica weapon. This replica weapon comprises at least one barrel for guiding the projectile launched by the projection device according to the invention.

A source of electrical energy, not shown, must be associated with the projection device of the invention to enable it to operate, said source not being part of the invention and remaining within the reach of those skilled in the art.

In these figures, a sheath 10 is represented which receives movable electromagnetic means 12 and a thrust nose 14.

The sheath 10 has a cylindrical inner shape of diameter D1. Preferably the sheath material is soft iron with very low carbon content or an iron/cobalt alloy.

Near the front end 10-1 of the sheath, an annular groove 10-3 is formed on the inner wall of the sheath.

According to one particular embodiment, the sheath 10 comprises at least one slit, in this case two slits 16-1, 16-2, each arranged along a cylinder generatrix, therefore parallel. These slits are through-slits and place the inside of the sheath in communication with the outside of said sheath.

These slits 16-1, 16-2, have a length L and extend substantially from the back end 10-2 of the sheath 10.

Figure 3:
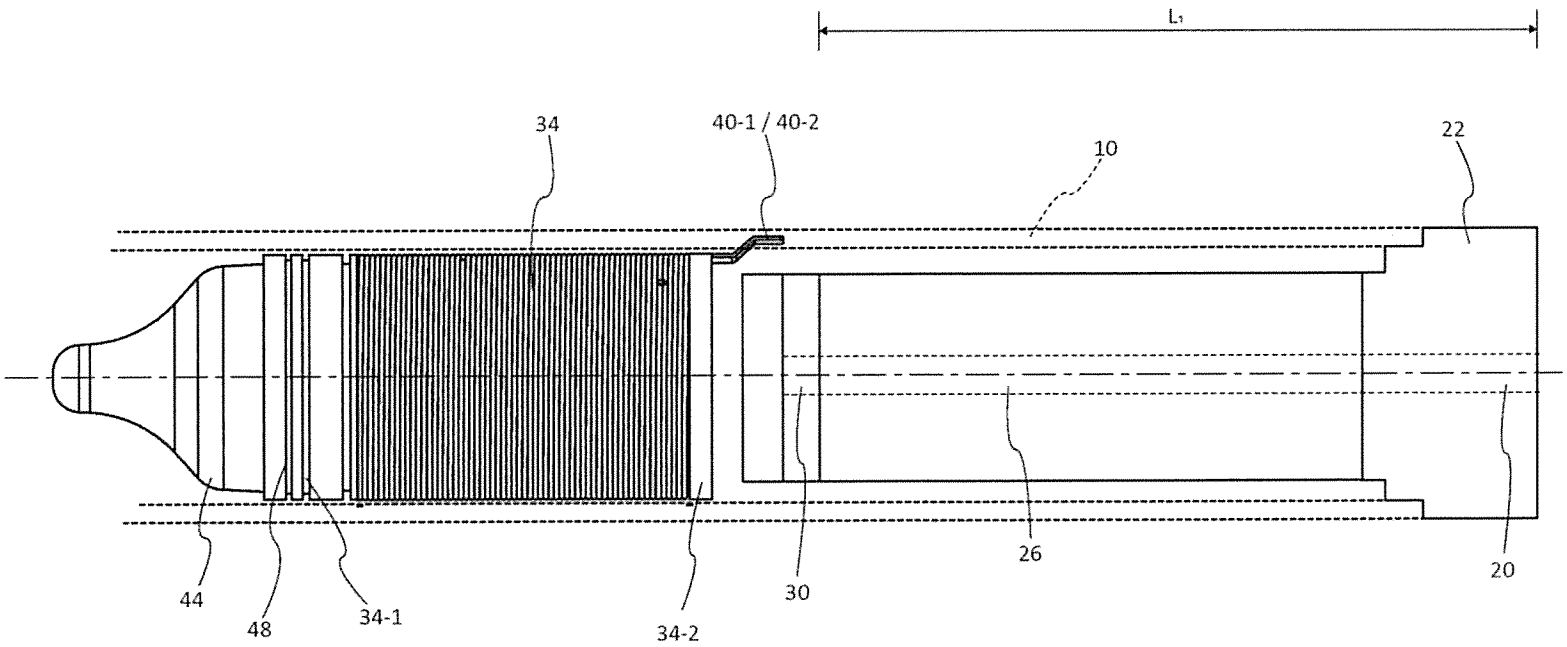
Figure 4:
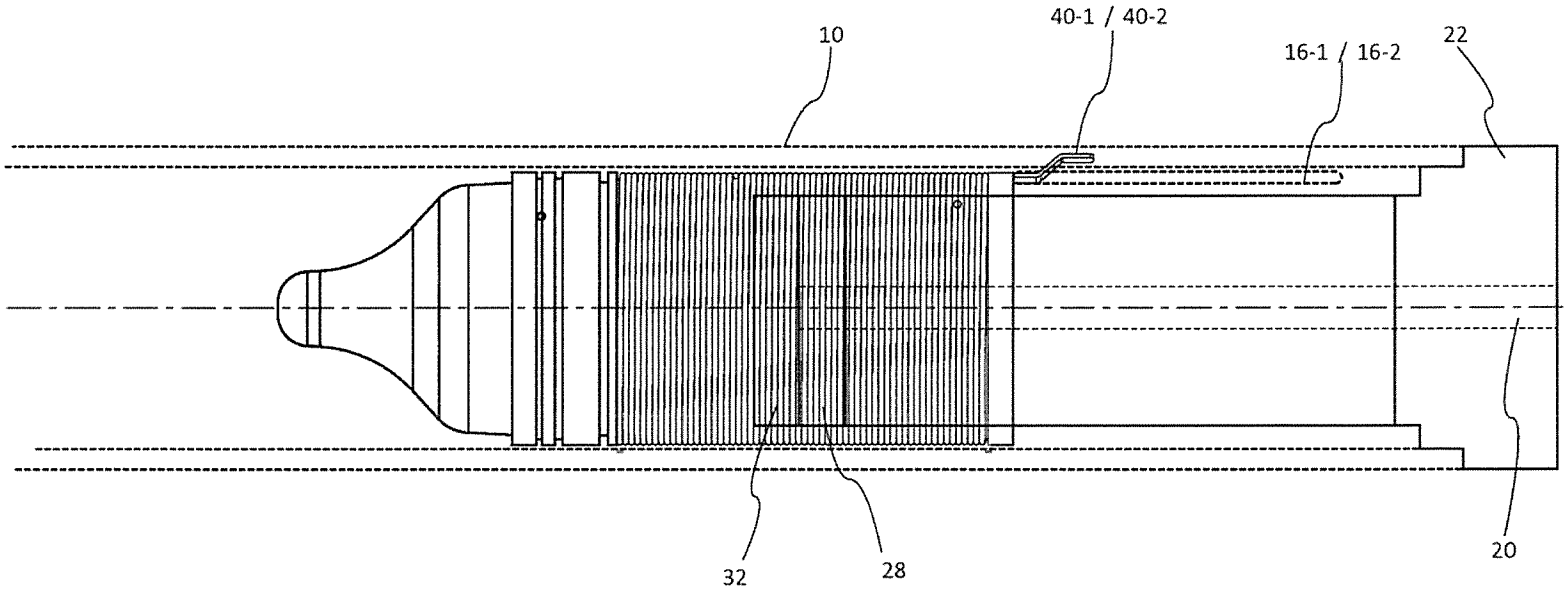
FIG. 4: a detailed section view of the electromagnetic projection means, after assembly.
Figure 5:
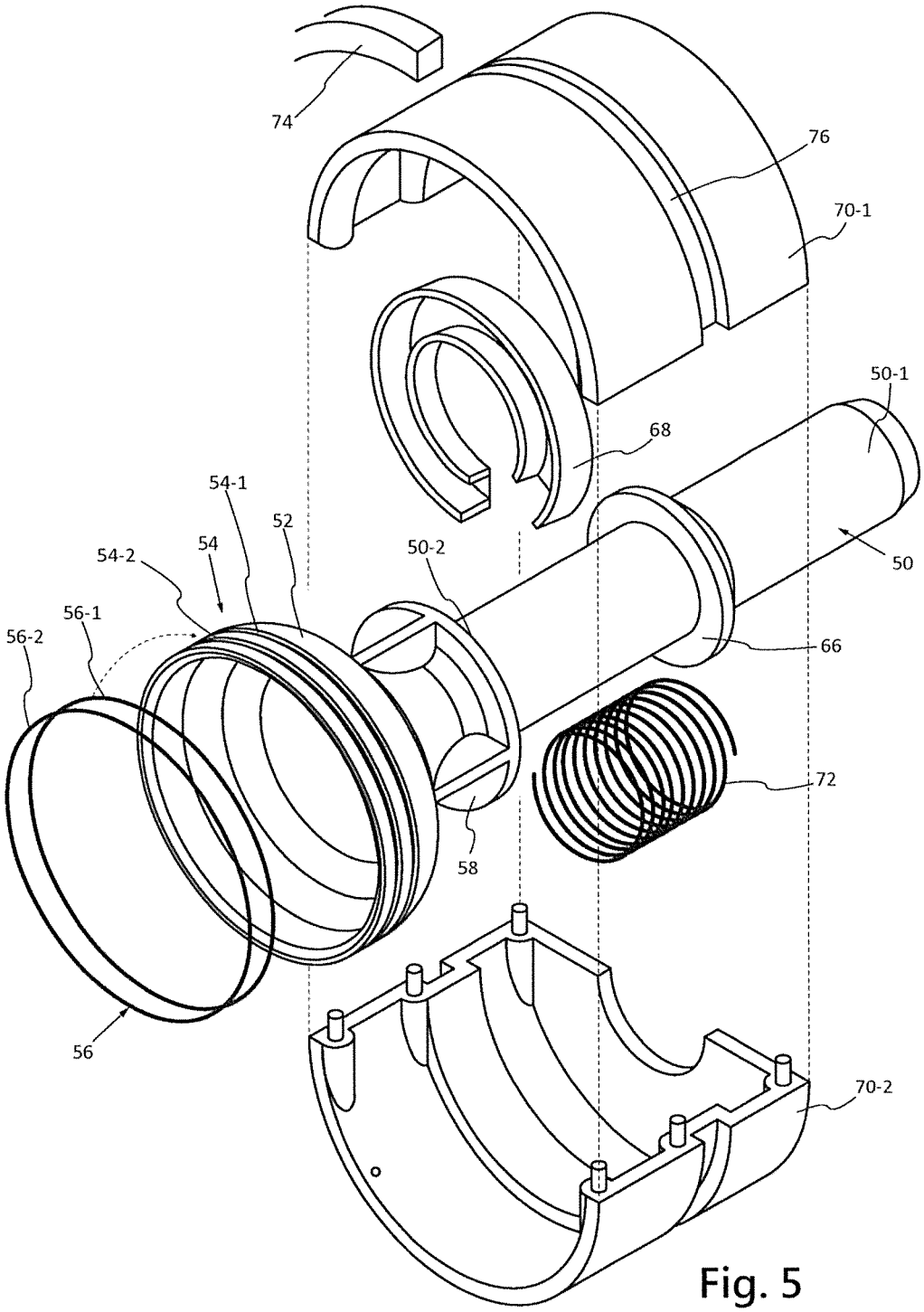
FIG. 5: an exploded perspective view of the thrust nose.

The sheath 10 receives the electromagnetic projection means 12 as detailed in FIGS. 3, 4, and 5. These electromagnetic means 12 comprise, at the back end 10-2 of the sheath 10, a breech 18 made of very soft iron with very low carbon content or an iron/cobalt alloy. This breech is fixed on the rear end of the sheath 10 by means of a turned portion of a diameter D2<D1, receiving the thickness of the sheath so that the breech has an outside diameter D1 that is identical to that of the sheath, as shown in FIG. 1.

This breech 18 comprises a second turned portion having a diameter D3<D2 so as to generate a space E referred to as circulation space.

In the preferred embodiment described, this breech 18 preferably has an axial passage hole 20 of diameter d, leading between the front side of the breech at 20-1 and the back side at 20-2. The back face 22 of the breech constitutes the rear of the device. The electromagnetic means 12 further comprise a permanent magnet 24, attached to the breech 18 to which it is integrally secured. This permanent magnet is in the form of a cylindrical bar having a diameter equal to D3.

The length of the permanent magnet 24 is such that the front end of the magnet 24 is at a distance L1 from the back face 22 of the breech 18.

This permanent magnet 24 is axially magnetized, meaning that the front end of the bar constitutes a north pole and the other back end constitutes a south pole.

This permanent magnet 24 is pierced with a central axial hole 26, also of diameter d.

A field plate 28 is attached to the permanent magnet 24. This field plate 28 is made of soft iron and is in the form of a ring having an outside diameter D3. This field plate 28 is also pierced with a central axial hole, also of diameter d.

This stack further comprises a dampener 32 in the form of a ring, of elastomer for example, attached to the field plate 28 and having the same outside diameter. This ring also has a central hole.

The electromagnetic projection means 12 are completed by a piston 34. This piston has a cylindrical cross-section and an outside diameter equal to D2-e and inside diameter equal to D3+e, e being a gap or clearance. The thickness of the piston 34 is therefore substantially equal to the circulation space E, apart from the clearance e.

Advantageously, the piston comprises a front guide area 34-1 and a back guide area 34-2 inside the sheath 10.

Between these two front 34-1 and back 34-2 guide areas, a turned portion 36 is created on the piston, for receiving a coil 38 of conductive wire, for example of copper or aluminum, in at least one layer.

The ends 38-1 and 38-2 of the wire forming this coil 38 protrude at the back of the piston and are connected, each for example by means of a rigid and conductive terminal 40-1, 40-2, to the source of electrical energy (not shown). The connection is for example obtained by a flexible braided connector 42-1 and 42-2 which connects the source of electrical energy and said rigid and conductive terminals.

In addition to the electrical connection, the rigid terminals 40 provide a mechanical guide and an anti-rotation effect because these terminals 40 are intended to pass through the slits 16-1, 16-2.

Upstream of the front guide area 34-1, on the front of the piston 34, a piston head 44 that is made as part of said piston 34 is provided.

This head 44 has a nipple shape with a rounded end, of a maximum diameter φ.

The nipple shape provides an excellent air penetration coefficient.

Advantageously, means 46 for establishing a seal relative to the inner surface of the sheath 10 are carried by said piston 34. These sealing means 46 may be in the form of at least one segmented seal or, as in the case shown, in the form of dynamic seals.

These dynamic seals consist of providing at least one peripheral groove 48, three grooves alongside the front guide area 34-1 in the embodiment shown, in the area where the space between the piston and the inner surface of the sheath is the smallest e. These grooves are irregularly spaced apart and may possibly have different depths in order to generate low pressure areas that eliminate any leaks. These grooves avoid the mechanical friction of a segment or a seal.

Figure 6:
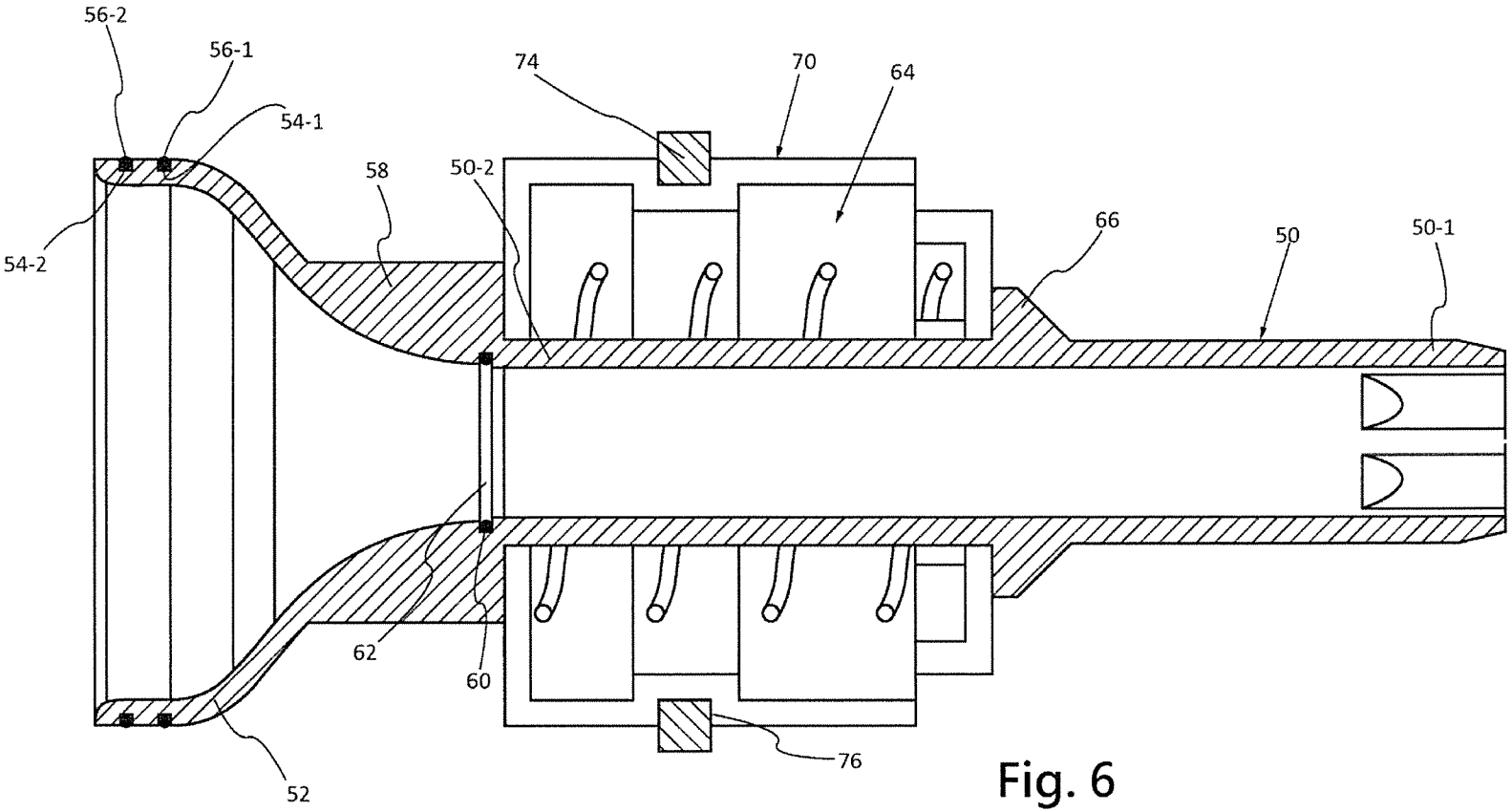
FIG. 6: a sectional view of the thrust nose, after assembly.

The thrust nose 14 comprises, as shown in detail in FIGS. 5 and 6, a projection tube 50 with a front end 50-1 and a back end 50-2.

The back end carries a cap 52, made as part of said tube, this cap having a profile cooperating with that of the piston 34 and more particularly the head 44 of the piston 34 and having a diameter Φ greater than φ in order to accommodate said piston.

This cap 52 comprises means 54 for establishing a seal with the inner wall of the sheath 10, in the form of at least one peripheral groove, in this case two grooves 54-1 and 54-2, each intended to receive a seal 56 that is an O-ring type seal 56-1 and 56-2.

These O-rings establish the seal with the inner surface of the sheath 10. The cap 52 receives the head 44 of the piston and a reinforcement 58 is arranged facing the contact surface as shown in FIG. 7 in particular. An O-ring type seal 60 is arranged in a groove 62 formed in the inner wall, at the back end 50-2 of the projection tube 50. This area is possibly reinforced for rigidity by the reinforcement 58, see FIG. 6.

The inner diameter of this seal 60 is less than that of the front tip of the head 44 of the piston, in order to ensure a seal with this front tip.

The thrust nose 14 also comprises return means 64 for returning it to position.

These return means 64 comprise a front stop 66, formed in and part of the tube, a retainer 68 adapted to be mounted on the tube and to bear against said stop, a cylindrical housing 70 formed as two half-shells 70-1 and 70-2 and intended to close around said projection tube 50, and a spring 72 interposed between the back end of said housing 70 and the retainer 68.

The two half-shells of the cylindrical housing 70 are held in place by positioning pins and by a peripheral circlip 74 which is housed in a groove 76.

The arrangement is shown assembled in FIGS. 7A to 7E.

The basic operation is represented in the overview given in these FIGS. 7A to 7E.

Figures 7A, 7B, 7C, 7D, 7E:
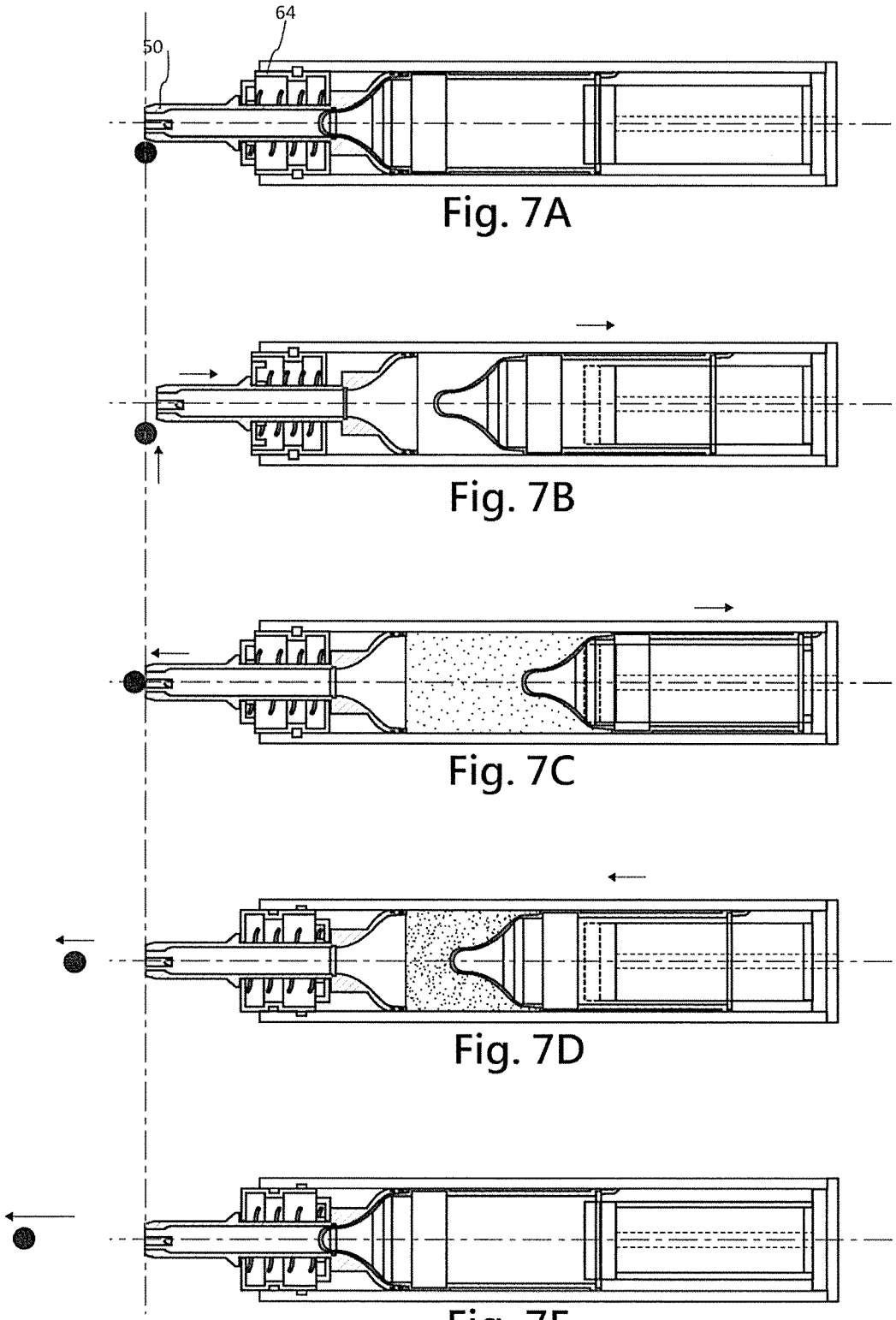
FIGS. 7A to 7E: a basic block diagram of the operation of the electromagnetic projection device according to the invention.

In FIG. 7A, the sheath has received the thrust nose and more particularly the cap 52. The housing 70 is held translationally immobile in the sheath by the circlip 74 which engages with the groove 10-3 formed in the sheath.

The piston 34 is at the front and its head 44 mates with the inside of the cap 52. The front tip of the head 44 is inserted into the seal 60 carried inside the rear portion 50-2 of the projection tube 50.

The spring 72 pushes the tube forward.

The piston 34 has its rear portion 34-2 which partially surrounds the magnet 24, the concentrator 28, and the dampener 32.

In FIG. 7B, when the coil 38 of the piston is supplied with current of +/− polarity, the field created generates a rearward force which moves the piston 34 rearward.

The retreat of the piston causes lower air pressure in front of the head 44 and inside the projection tube 50, as well as friction on the seal 60, which causes the projection tube 50 to retreat against the return force of the spring 72. This retreat allows a pellet B to be introduced in front of the forward end of the projection tube 50.

During the retreat of the piston 34, the air from the chamber at the rear of the piston is expelled through the succession of holes of diameter d, 20, 26, 30, including through the dampening ring.

In FIG. 7C, the piston 34 has retreated as far back as possible and the inside of the head 44 of the piston 34 is in abutment with the dampener 32.

The sealing means 46 have played their role and the piston has been perfectly guided within the sheath 10 by the guide areas 34-1 and 34-2 during this retreat phase.

During this phase, after retreating for a very short distance (substantially the diameter of the pellet B), the projection tube 50 is brought forward by the spring 72 and the pellet is positioned immediately in front of the forward end 50-1 of the projection tube 50.

Generally, a seal in the barrel holds the pellet in position so that it cannot be displaced by the movements of the replica weapon alone.

The pellet B remains in front of the end of the projection tube.

In FIG. 7D, the polarity of the current is reversed −/+ and during the supply of power, the piston 34 is moved forward with great force due to the almost complete superposition of the coil 38 of said piston and the permanent magnet 24.

The pellet B receives pressurized air which launches it and accelerates its motion.

The air is compressed during the translational movement of the piston, due to the seal generated by the sealing means 46 of the piston 34 and the seals 56-1, 56-2 of the cap 52.

As the piston advances until it abuts against the piston cap, see FIG. 7E, the velocity increases and the pressure is maintained, which ensures the projection of the pellet already launched at high speed, acceleration being constant during active displacement of the piston.

Figure 8:
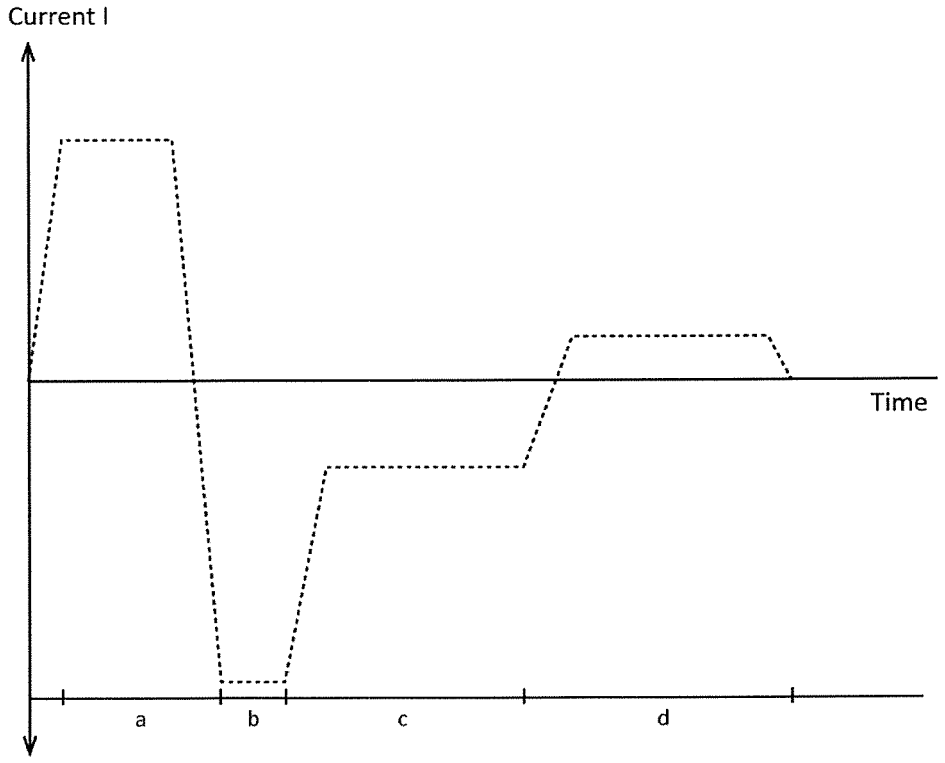
FIG. 8: a phase diagram illustrating the method for controlling the electromagnetic projection device according to the invention.

This operation achieves excellent energy efficiency, nearly 90%. FIG. 8 shows the operating phases of the control method for the device just described.

In this figure, phase a/ corresponds to the air compression phase, the piston moving forward in an acceleration phase that is kept constant, followed by a braking phase b/ achieved by reversing the polarity of the current, just before the piston abuts against the piston cap.

Next, the piston retreats slowly during a phase c/ which consumes very little energy, and then the piston is braked in its retreating movement during a phase d/, before returning to the initial position.

Movement of the piston is thus perfectly managed and controlled to give constant acceleration until the end of the stroke and to reduce energy consumption.

This ensures flexibility in the movements, without significant impacts to the weapon or in the recoil effect after shooting, while maintaining good impressions of the shot and its different phases.

Figure 9:
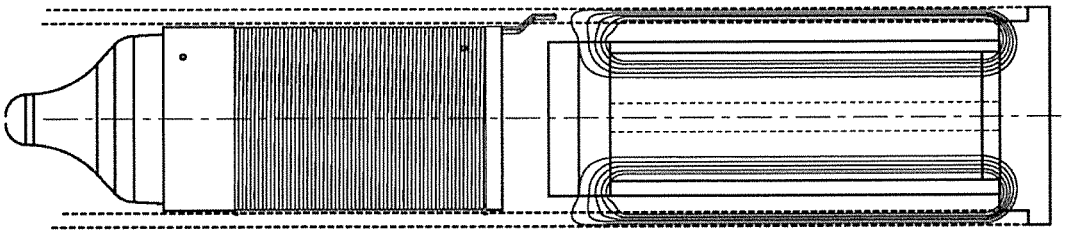
FIG. 9: a view of the diagram of the magnetic fluxes in play.

The magnetic field lines and the induced forces are symbolized in FIG. 9 for better visualization of the phenomena.

Figure 10:
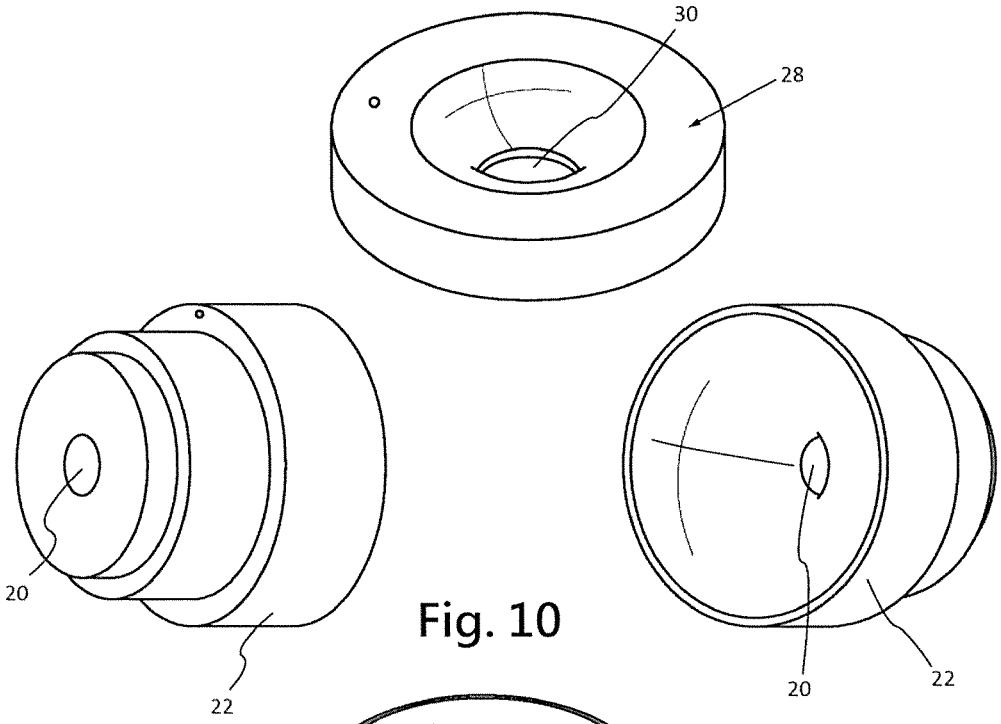
FIG. 10: a first embodiment of the vent of the field plate and the breech.
Figure 11:
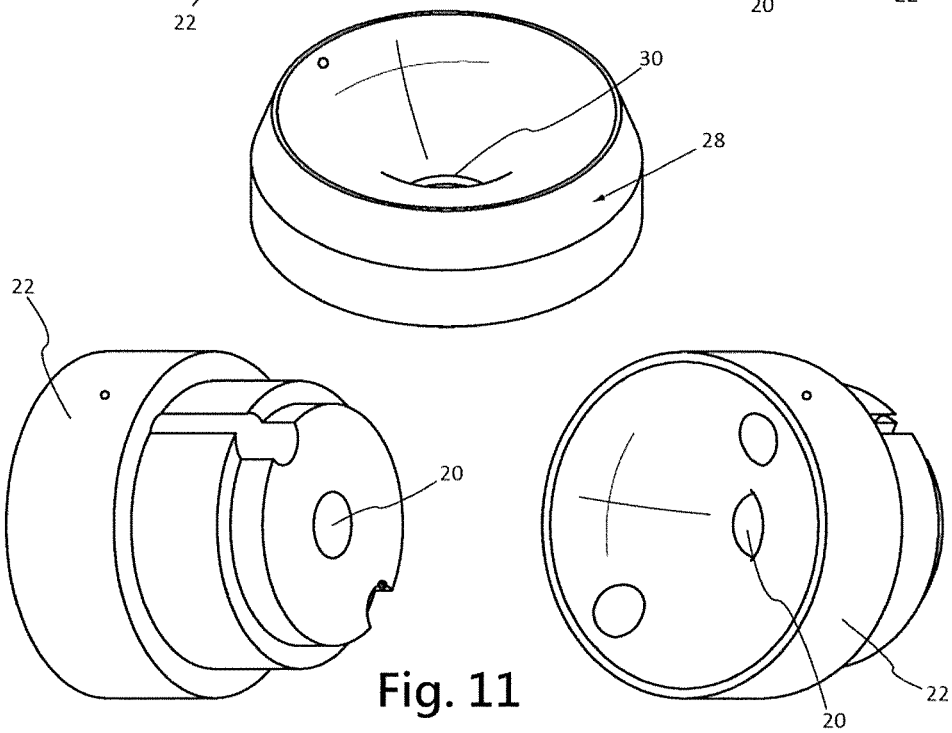
FIG. 11: a second embodiment of the vent of the field plate and the breech.

In order to improve efficiency, losses are reduced, in particular by the presence of vents in the two variants shown in FIGS. 10 and 11.

These vents are formed at the edge of the holes 30 of the concentrator 28 and the outlet of the breech 18.

These vents facilitate the venting of air from the device during the rearward translation of the piston and the introduction of air from outside the device during the forward translation of the same piston. The flows are not turbulent as they would be when exiting an irregular hole and do not generate drag, therefore not resulting in energy losses and excess energy consumption.

Similarly, the piston head is nipple-shaped to provide good air penetration during movement, but the shape can have any profile providing improved penetration, shapes resulting from aerodynamic studies being within the reach of a person skilled in the art.

The material of the piston may be chosen among composite materials, in order to reduce weight and limit interference with the magnetic fields, allowing them to act with maximum efficiency.

According to an alternative arrangement, the ends of the conductive wires of the coil 38 may also pass through passages formed through the breech 18, the slits provided on the sheath then being eliminated.

The polarities mentioned in the foregoing description have been described as +/− and −/+ solely to indicate a polarity reversal, but the direction is to be adapted to the embodiment, the choice of orientation of the permanent magnet dictating the choice of directions of movements, particularly the polarities.

The invention claimed is:

1. A device for projecting a projectile B using a compressed air, intended for integration into a replica weapon and associated with a source of electrical energy, comprising:

a sheath (10) which receives an electromagnetic projector (12) for moving a movable piston (34) within the sheath (10) between a thrust nose (14) sealing a front (10-1) of the sheath provided with a projection tube (50), and a breech (18) sealing a rear (10-2) of the sheath;

wherein the electromagnetic projector (12) for moving the movable piston (34) comprise:

a permanent magnet (24) integral with the breech (18), and a coil (38) of conductive wire, arranged on the movable piston (34) and electrically connected to the source of electrical energy;

wherein the electromagnetic projector (12) for moving the movable piston (34) within the sheath (10) comprise:

a field plate (28) associated with the permanent magnet.

2. The device for projecting a projectile B using a compressed air according to claim 1, wherein the sheath (10) comprises:

at least one slit (16-1, 16-2) arranged along a cylinder generatrix of the sheath and being a through-slit, wherein ends (38-1, 38-2) of the conductive wire forming the coil (38) protrude at a back of the movable piston (34) and are each integrally secured to a rigid and conductive terminal (40-1, 40-2) integral to a rear of the movable piston (34).

3. The device for projecting a projectile B using a compressed air according to claim 1, wherein the breech (18), the permanent magnet (24), and the field plate (28) have a hole (20, 26, 30), respectively.

4. The device for projecting a projectile B using a compressed air according to claim 3, wherein the holes of the field plate (28) and the breech (18) on a back face (22) have a vent.

5. The device for projecting a projectile B using a compressed air according to claim 1, wherein the movable piston (34) carries a first sealer (46) for establishing a seal relative to an inner surface of the sheath (10).

6. The device for projecting a projectile B using a compressed air according to claim 5, wherein the first sealer (46) for establishing a seal relative to the inner surface of the sheath (10) are dynamic seals in a form of at least one peripheral groove (48).

7. The device for projecting a projectile B using a compressed air according to claim 1, wherein the thrust nose (14) comprises:

a projection tube (50) with a front end (50-1) and a back end (50-2);

a cap (52) having a profile mating with that of the movable piston (34);

a second sealer (54) for establishing a seal with an inner wall of the sheath (10); and a returner (64) for returning the projection tube (50) to its position.

8. The device for projecting a projectile B using a compressed air according to claim 7, wherein the returner (64) comprise:

a front stop (66), formed in and part of the projection tube (50);

a retainer (68) adapted to be mounted on the projection tube and to bear against the front stop;

a cylindrical housing (70) formed as two half-shells (70-1, 70-2), secured by a peripheral circlip (74) and intended to close around the projection tube (50); and a spring (72) interposed between a back end of the cylindrical housing (70) and the retainer (68).

9. The device for projecting a projectile B using a compressed air according to claim 1, wherein the sheath (10) and the breech (18) are made of a metal selected among soft iron with very low content carbon or an iron/cobalt alloy.

10. A method for controlling the device according to claim 1, comprising:

supplying a current of a polarity +/− to a coil (38) of the movable piston (34) within the sheath (10), so as to cause the movable piston (34) to move rearward in translation until the movable piston (34) reaches a stop, reversing the polarity −/+ of the current supplied to the coil (38), so as to cause the movable piston (34) to move forward in translation until movable piston abuts against the thrust nose (14).

11. The method for controlling the device according to claim 10, comprising:

supplying the current of the polarity +/− to the coil (38) of the movable piston (34) so as to cause the movable piston (34) to move rearward, reversing the polarity −/+ of the coil (38) before the movable piston (34) abuts against the stop, in order to slow the movable piston, supplying the current of the polarity −/+ to the coil (38) of the movable piston (34) so as to cause the movable piston (34) to move forward, and reversing the polarity +/− of the coil (38) before the movable piston (34) abuts against the thrust nose (14), in order to slow the movable piston.

* * * * *